United States Patent [19]

Jackson

[11] 4,265,401

[45] May 5, 1981

[54] ADJUSTABLE GUARD RAIL STRUCTURES

[75] Inventor: Bertie Jackson, Cincinnati, Ohio

[73] Assignee: L. B. Foster Company, Pittsburgh, Pa.

[21] Appl. No.: 18,885

[22] Filed: Mar. 9, 1979

[51] Int. Cl.[3] ..... E01B 5/18
[52] U.S. Cl. ..... 238/17; 238/22
[58] Field of Search ..... 238/17-23

[56] References Cited

U.S. PATENT DOCUMENTS

| | | | |
|---|---|---|---|
| 949,253 | 2/1910 | Alden | 238/22 |
| 2,024,110 | 12/1935 | O'Neill | 238/20 |
| 3,964,679 | 6/1976 | Frank | 238/17 |

FOREIGN PATENT DOCUMENTS

| | | | |
|---|---|---|---|
| 5583 | of 1912 | United Kingdom | 238/22 |

*Primary Examiner*—Richard A. Bertsch
*Attorney, Agent, or Firm*—Buell, Blenko, Ziesenheim & Beck

[57] ABSTRACT

An adjustable guard rail assembly is provided for use with a running rail and is made up of a plurality of spaced base plates having one end extending beneath the running rail, brace means fixed to each base plate adjacent the other end, a guard rail supported on said spaced base plates and abutting said braces, fastening means extending through said brace and guard rail and interchangeable spacer means on said fastening means interchangeable from one side of the guard rail to the other whereby the position of said guard rail with respect to the brace may be changed.

6 Claims, 6 Drawing Figures

ADJUSTABLE GUARD RAIL STRUCTURES

This invention relates to adjustable guard rail structures and particularly to a guard rail structure for use in railroad track structures such as turnouts, crossings, turnout and crossing approaches and tracks with severe curvature.

The function of a guard rail varies with the location and type of rail assembly in which it is installed. Guard rails in turnouts are intended to protect the frog point; in crossings, guard rails both protect the frog points and prevent the wheels from climbing the running rails; in sharp curves, guard rails aid in reducing side wear on the high or outside rail. The effectiveness of a guard rail depends to a great extent on maintaining correct flangeway width between the running rail and the guard rail. As the rails take on side wear, the flangeway width keeps widening until it is too wide for the guard rail to be effective. When the flangeway width exceeds permissible tolerances, the guard rail is replaced with a new one, often with the supporting plates and other accessories.

The problem of guard rail wear has been long recognized and many proposals for overcoming this problem have been advanced. Typical of such prior art arrangements are those shown in Burkhardt et al. U.S. Pat. No. 2,239,480, Willson et al. U.S. Pat. No. 1,230,256, Miller U.S. Pat. No. 853,254, Elvin U.S. Pat. No. 843,880, Korns U.S. Pat. No. 843,897, Glenton U.S. Pat. No. 843,939, Rutter U.S. Pat. No. 802,660, Corts U.S. Pat. No. 759,677, Cummins U.S. Pat. No. 536,134, Cummins U.S. Pat. No. 509,203, British Pat. No. 5583, and French Pat. No. 421,472. All of these patents show devices for adjusting a guard rail relative to a running rail and all have the common characteristic of fastening the guard rail and running rail together using a series of parallel bolts extending through holes in both rails. In each case the rails are adjusted relative to each other by means of tapered wedges or shims around the bolts. In some cases the bolts also provide some adjusting and holding effect by a turnbuckle arrangement in conjunction with the wedges. In every case, however, the two rails are bolted together. These arrangements while effective for the purpose have many drawbacks. One of the major drawbacks is the fact that many separate pieces are involved which cannot be preassembled as a unit or structural assembly. As a result, pieces are readily lost in transit to the field and in the necessary field assembly. Another major drawback is that the running rail must be drilled to receive the guard rail bolt, either in the field or a special rail section must be fabricated to go with the guard rail and be assembled therewith at the time of installation.

The present invention eliminates these as well as other drawbacks of prior art adjustable guard rail structures. It provides a guard rail assembly which can be preassembled where made and taken to the field complete and ready for assembly without loose parts or pieces.

This invention provides an adjustable guard rail assembly for use with a running rail including a plurality of spaced base plates having an end extending beneath the running rail, brace means fixed to each base plate adjacent to other end of said base plate, a guard rail supported on said spaced base plates and abutting said braces, fastening means extending through each said brace and guard rail and interchangeable spacer means on said fastening means interchangeable from one side of the guard rail to the other whereby the position of said guard rail with respect to the brace and running rail may be changed. A removable riser plate is placed between the base plate and guard rail, said riser plate having a downwardly projecting stop or finger fitting within an opening in the base plate and a projecting flange on said riser plate spaced above the base plate and extending over one side of the base of the running rail and having an opposite face abutting one of the base of the guard rail and the spacer means. Preferably, the fastening means is a bolt extending through the brace and guard rail. The brace is preferably welded to the base plate to form an integral unit and is provided with a recess receiving one edge of the base of the guard rail. Preferably, the spacer means is a plurality of pieces of thin plate having a hole through which the fastening bolt passes.

In the foregoing general description, certain objects, purposes and advantages of this invention have been set out. Other objects, purposes and advantages of this invention will be apparent from a consideration of the following description and the accompanying drawings in which.

Figure 1:
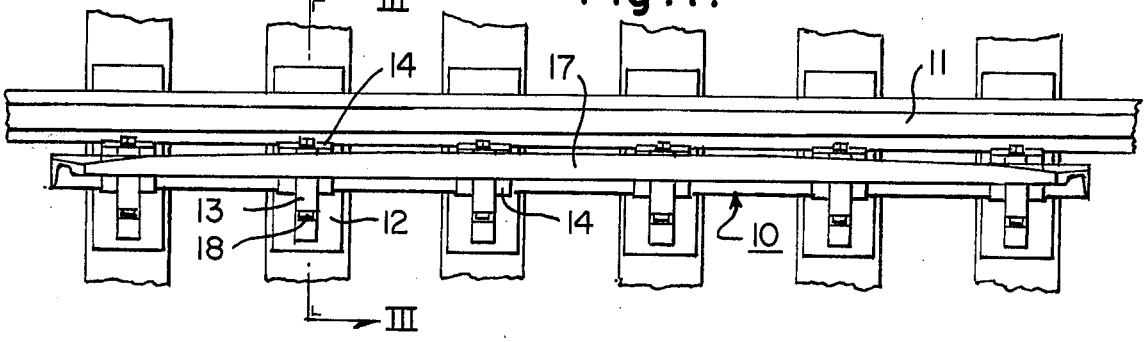
FIG. 1 is a plan view of an adjustable guard rail assembly according to this invention.
Figure 2:
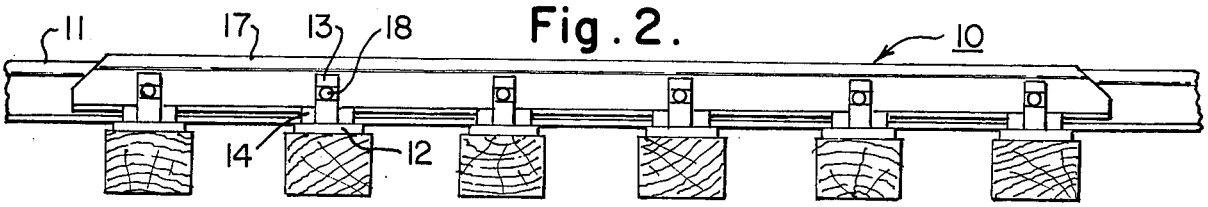
FIG. 2 is a side elevational view of the guard rail assembly of FIG. 1.

Referring to the drawings, there is illustrated in FIG. 1 an adjustable guard rail assembly 10 according to this invention in position on a running rail 11. The guard rail assembly is made up of a series of base plates 12, each having a solid steel brace member 13 welded thereon at one end. Each base plate carries a riser plate 14, preferably of malleable iron having a depending finger 15 engaged in an opening 16 in the base plate. The guard rail 17 rests on riser plate 14 and is bolted to brace member 13 by bolt 18. Spacers 19 and 20 of appropriate size are inserted on bolt 18 against guard rail 17 on opposite sides thereof and spacer shims 21 are inserted on the side facing the running rail 11. As the head 22 of guard rail 17 wears, the distance from head 22 of the guard rail 17 and head 23 of the running rail 11 will enlarge. When this reaches a predetermined amount, one spacer shim 21 is shifted to the side of guard rail 17 opposite running rail 11 on each brace so as to shift the guard rail to the left, viewing FIGS. 3 and 4, bringing heads 22 and 23 closer together. This is repeated so long as spacers 21 are available.

The entire guard rail assembly 10 is inserted in one piece avoiding the multiplicity of pieces characteristic of prior art guard rail installation.

Figure 3:
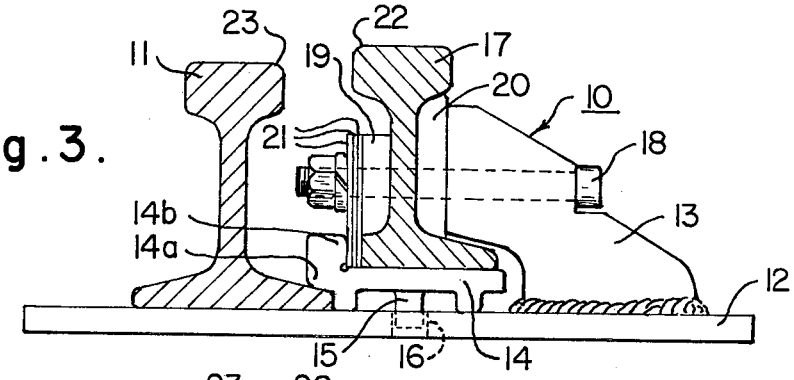
FIG. 3 is a section on the line III—III of FIG. 1.
Figure 4:
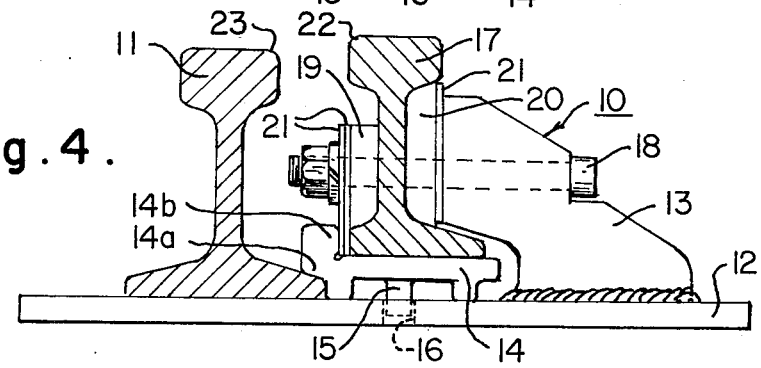
FIG. 4 is a section on the line III—III showing an adjustment shim repositioned.
Figure 5:
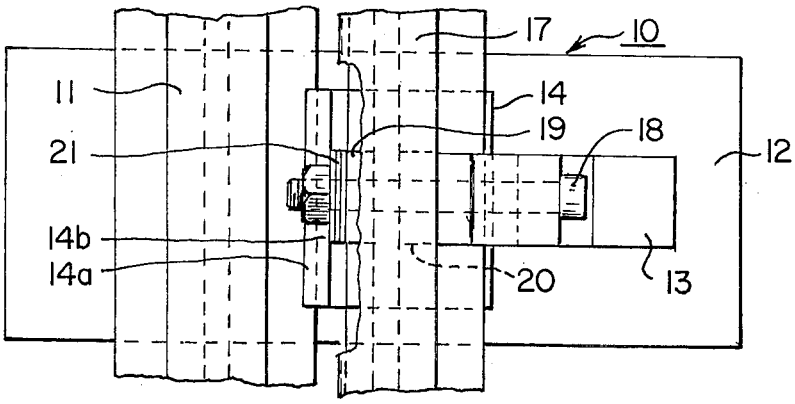
FIG. 5 is a fragmentary top plan view of the brace and base plate of FIG. 3.
Figure 6:
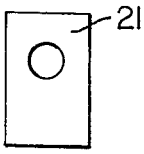
FIG. 6 is a side elevational view of a spacer shim according to this invention.

In use, the guard rail transmits the horizontal thrust of the wheels onto the brace 13 and the brace in turn transmits the load on to the base plate and the base plate distributes the load over a wide area on the tie. The spacers 19 and 20 provide proper bearing of the brace against the web of the guard rail 17. The riser plate 14 maintains the guard rail 17 at the proper height in relation to the running rail 11. Thus, the top of the guard rail 17 can be designed to be either level with the running rail or raised by a specified amount above the top of the running rail. The riser plate 14 also has a projecting flange 14*a* on one side which acts as a hold down device for the running rail 11 and as a back up and indexing stop 14*b* for shims 21 and rail 17. Without this feature, the running rail 11 is not held down on one side for the entire length of the guard rail. Thus, the longer the guard rail, the longer is the otherwise unsupported length of the running rail. The third function of the riser plate 14 is to keep the entire assembly intact regardless of whether the nut on the bolt is tight or not. A typical adjustment spacer shim 21 is shown in FIG. 6. The thickness and number of shims provided can be varied to obtain different steps and ranges of adjustment. Typically, three shims of each $\frac{1}{8}''$ thickness will give a total range of adjustability equal to $\frac{3}{8}''$ and each step will equal $\frac{1}{8}''$. By making one of the three shims 1/16" thick, the adjustment can be made in steps of 1/16". When new, the adjustable guard rail will have all the shims located as illustrated in FIG. 3. For each stage of adjustment, the nut will be loosened, the bolt pulled back and one shim will be moved from its original position. The shim will be turned upside down and inserted between spacer 20 and the brace 13 and the washer and the nut will be reinstalled as shown in FIG. 4. When the guard rail is ready for a second adjustment, one more shim is moved from the front and inserted between the brace and the spacer. The above procedure is repeated until the last of the shim is repositioned and the flangeway width corrected to its design value. Thus, the useful life of the adjustable guard rail is considerably longer than one without the adjustment feature.

In the foregoing specification certain preferred embodiments and practices of this invention are set out; however, it will be understood that this invention may be otherwise embodied within the scope of the following claims.

I claim:

1. An adjustable guard rail assembly for use with a running rail comprising a plurality of spaced base plates each having one end extending beneath the running rail, brace means fixed to each base plate adjacent the other end, a guard rail supported on said spaced base plates and abutting said braces, fastening means extending through said brace and guard rail and interchangeable spacer means on said fastening means interchangeable on said fastening means from one side of the guard rail to the other whereby the position of said guard rail with respect to the brace may be changed.

2. An adjustable guard rail assembly as claimed in claim 1 having a removable riser plate between the base plate and the guard rail.

3. An adjustable guard rail assembly as claimed in claim 2 wherein the riser plate has a depending finger extending into an opening in the base plate.

4. An adjustable guard rail assembly as claimed in claim 2 or 3 wherein the riser plate has a projecting flange spaced above the base plate and extending over the edge of the base of the running rail, said flanging having an opposite face abutting one of the base of the guard rail and spacer means.

5. An adjustable guard rail assembly as claimed in claim 1, 2 or 3 wherein the fastening means is a bolt.

6. An adjustable guard rail assembly as claimed in claim 1, 2 or 3 wherein the brace has a recessed portion receiving one edge of the base of the guard rail and riser plate.

* * * * *